US010323836B2

(12) United States Patent
Guajardo

(10) Patent No.: US 10,323,836 B2
(45) Date of Patent: Jun. 18, 2019

(54) LIGHT EMITTING BOWL ASSEMBLY

(71) Applicant: Aaron Guajardo, Orange, CA (US)

(72) Inventor: Aaron Guajardo, Orange, CA (US)

( * ) Notice: Subject to any disclaimer, the term of this patent is extended or adjusted under 35 U.S.C. 154(b) by 0 days.

(21) Appl. No.: 15/805,911

(22) Filed: Nov. 7, 2017

(65) Prior Publication Data

US 2019/0137086 A1 May 9, 2019

(51) Int. Cl.

| | |
|---|---|
| ***F21V 23/06*** | (2006.01) |
| ***F21V 23/04*** | (2006.01) |
| ***F21S 10/04*** | (2006.01) |
| ***F21S 9/02*** | (2006.01) |
| *F21Y 115/10* | (2016.01) |

(52) U.S. Cl.

CPC ..... *F21V 23/06* (2013.01); *F21S 9/02* (2013.01); *F21S 10/04* (2013.01); *F21V 23/04* (2013.01); *F21Y 2115/10* (2016.08)

(58) Field of Classification Search

CPC ..... F21S 10/04; F21V 23/06
USPC ..... 362/653, 657, 249.16
See application file for complete search history.

(56) References Cited

U.S. PATENT DOCUMENTS

| | | | | |
|---|---|---|---|---|
| 5,124,903 A | | 6/1992 | Coviello | |
| 5,315,492 A | | 5/1994 | Davenport | |
| 5,535,108 A | * | 7/1996 | Logsdon | F21S 9/02 362/183 |
| 5,683,762 A | * | 11/1997 | Banschick | A01G 5/04 211/13.1 |
| 6,186,646 B1 | * | 2/2001 | Wiedemer, Jr. | H01R 33/92 362/227 |
| 6,206,450 B1 | * | 3/2001 | Ide | B60J 7/1291 296/107.09 |
| 6,241,362 B1 | | 6/2001 | Morrison | |
| D725,308 S | | 3/2015 | Coleman | |
| 2005/0185398 A1 | * | 8/2005 | Scannell, Jr. | A01G 9/02 362/227 |
| 2005/0194930 A1 | * | 9/2005 | Barbeau | F21L 2/00 320/116 |
| 2005/0239007 A1 | * | 10/2005 | Dell'Aquila | F21S 6/001 431/125 |
| 2006/0070093 A1 | | 3/2006 | Mangano | |
| 2007/0223217 A1 | * | 9/2007 | Hsu | F21S 6/001 362/183 |
| 2008/0117634 A1 | * | 5/2008 | Wong | F21S 6/001 362/276 |
| 2009/0073694 A1 | | 3/2009 | Scannell, Jr. | |
| 2010/0027250 A1 | | 2/2010 | Chen | |

FOREIGN PATENT DOCUMENTS

| | | |
|---|---|---|
| WO | WO9403669 | 2/1994 |

* cited by examiner

*Primary Examiner* — Christopher M Raabe

(57) ABSTRACT

A light emitting bowl assembly for facilitating an ornamental festive display includes a bowl that may be positioned on a support surface. A plurality of candle units is provided and each of the candle units is selectively positioned in the bowl. Each of the candle units is arranged in a selected arrangement and the bowl. Moreover, each of the candle units is selectively turned on to selectively emit light outwardly therefrom. In this way the candle units enhance an ornamental appearance of the bowl.

12 Claims, 6 Drawing Sheets

LIGHT EMITTING BOWL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to light devices and more particularly pertains to a new light device for facilitating an ornamental festive display.

BRIEF SUMMARY OF THE INVENTION

An embodiment of the disclosure meets the needs presented above by generally comprising a bowl that may be positioned on a support surface. A plurality of candle units is provided and each of the candle units is selectively positioned in the bowl. Each of the candle units is arranged in a selected arrangement and the bowl. Moreover, each of the candle units is selectively turned on to selectively emit light outwardly therefrom. In this way the candle units enhance an ornamental appearance of the bowl.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
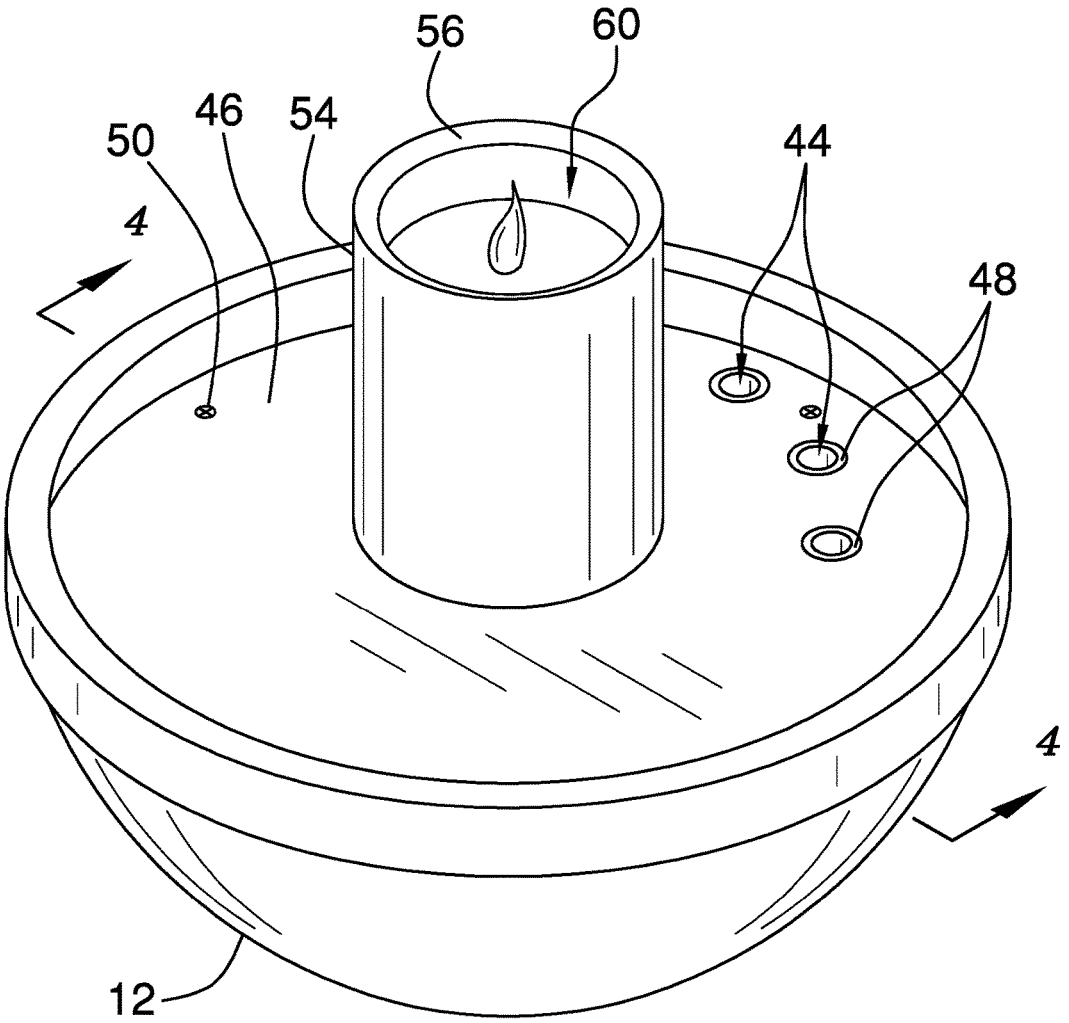
FIG. 1 is a top perspective view of a light emitting bowl assembly according to an embodiment of the disclosure.
Figure 2:
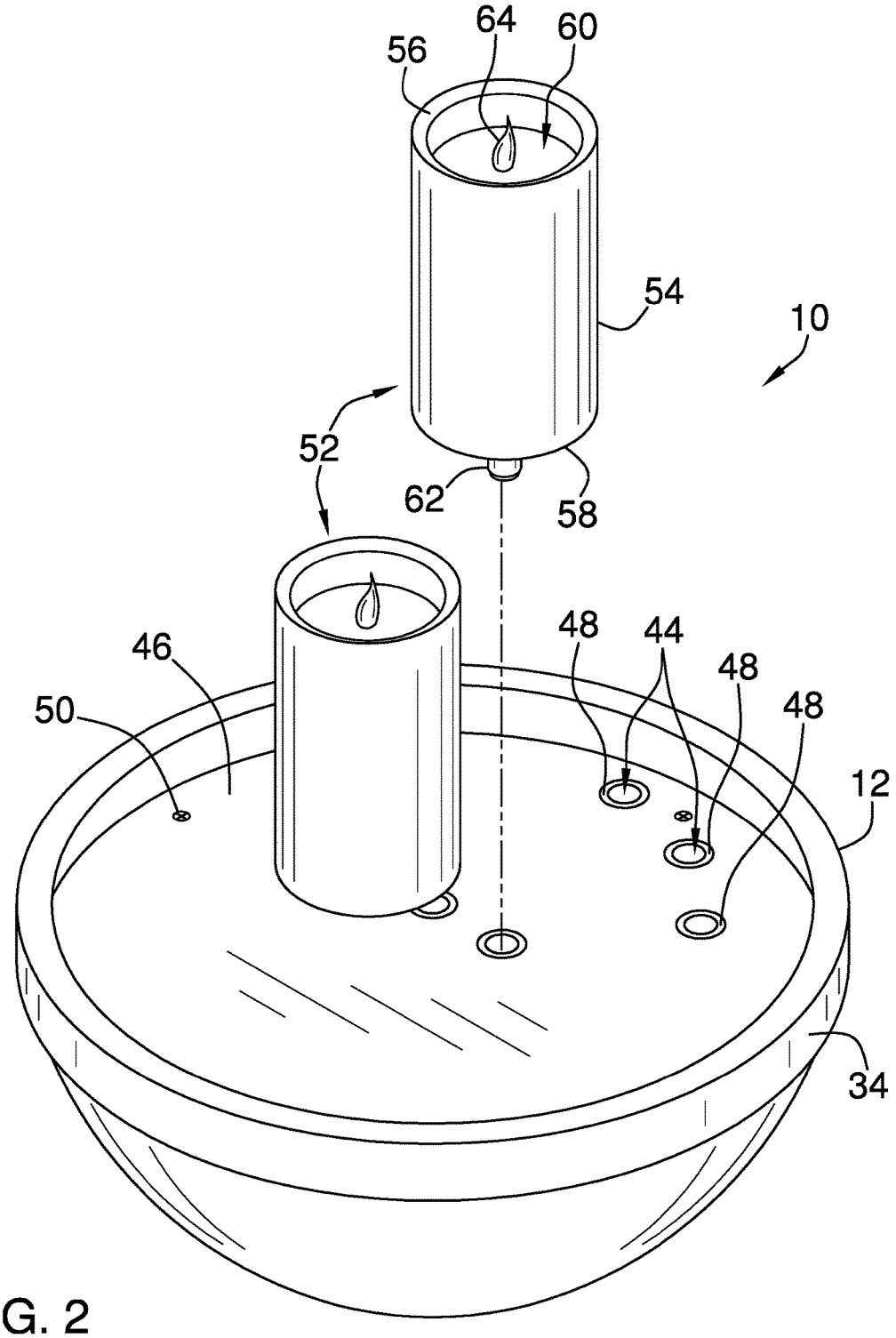
FIG. 2 is an exploded perspective view of an embodiment of the disclosure.
Figure 3:
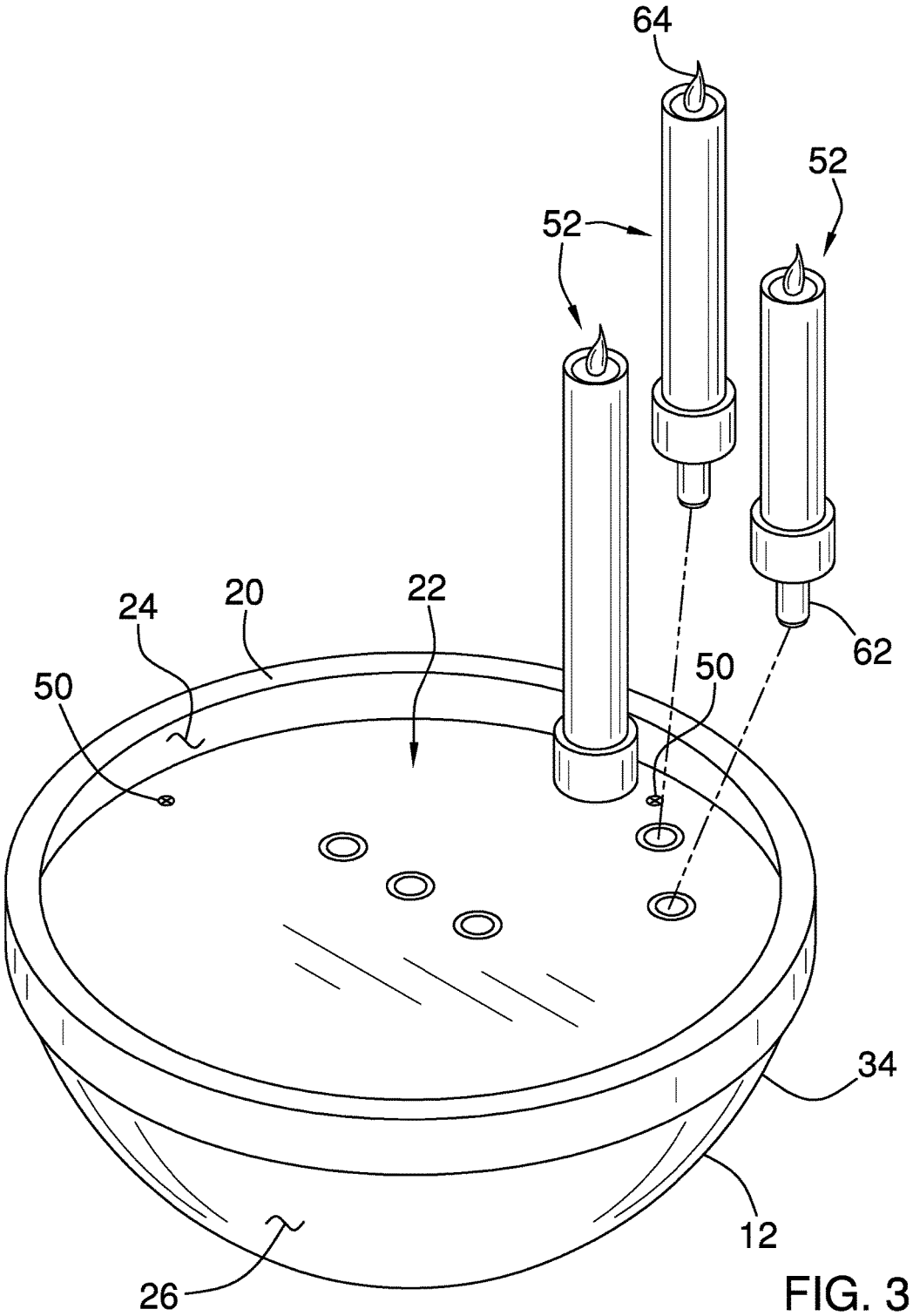
FIG. 3 is an exploded top perspective view of an embodiment of the disclosure.
Figure 4:
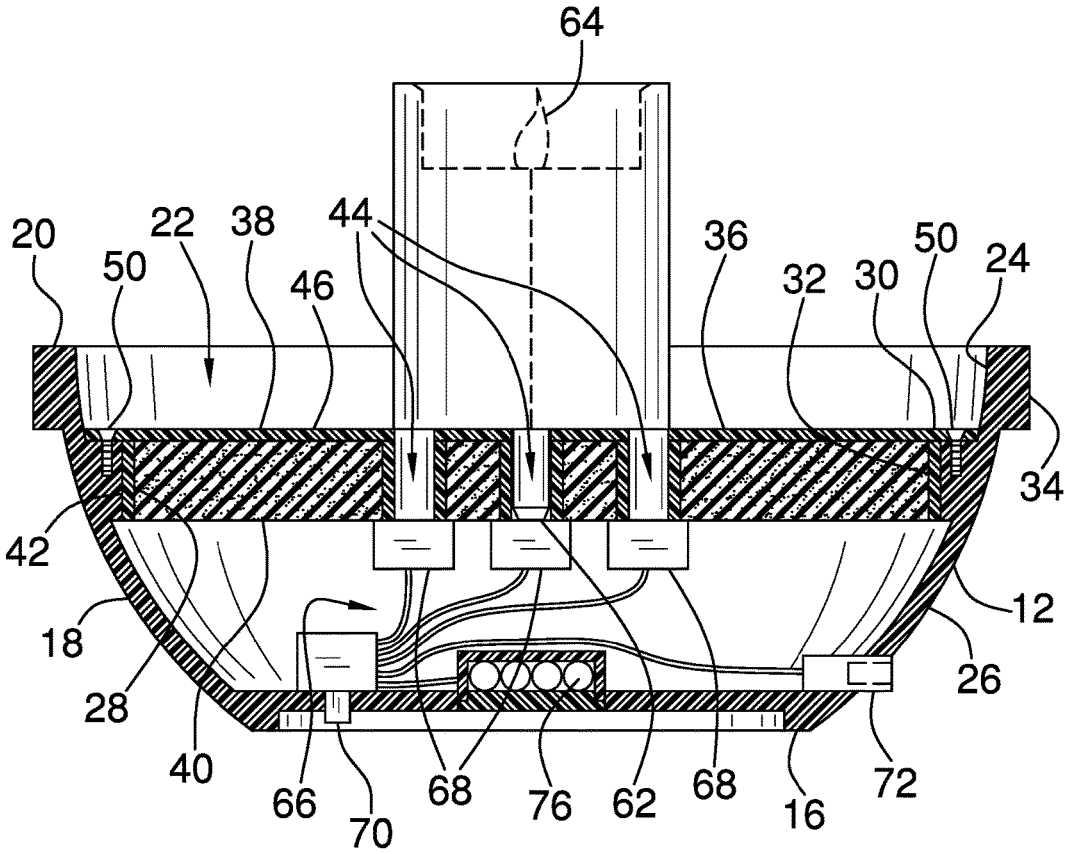
FIG. 4 is a cross sectional view taken along line 4-4 of FIG. 1 of an embodiment of the disclosure.
Figure 5:
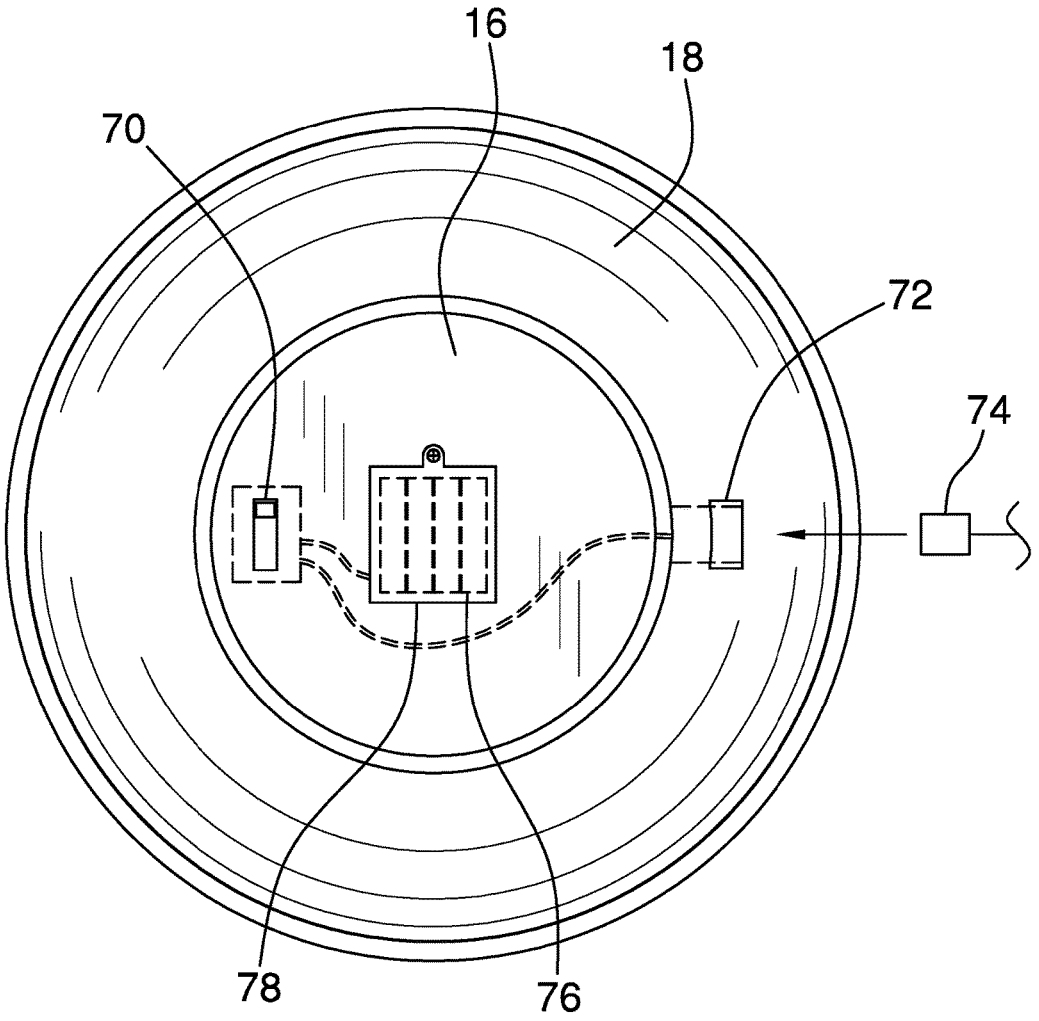
FIG. 5 is a bottom phantom view of an embodiment of the disclosure.
Figure 6:
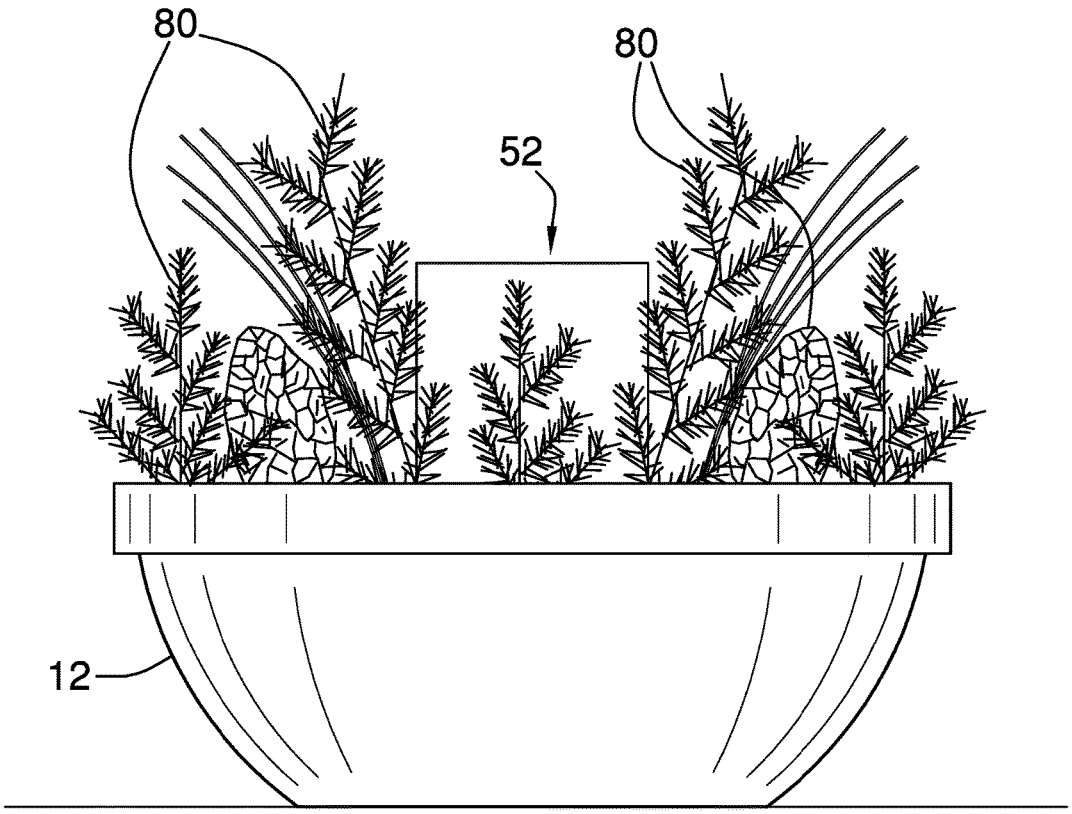
FIG. 6 is a perspective in-use view of an embodiment of the disclosure.

With reference now to the drawings, and in particular to FIGS. 1 through 6 thereof, a new light device embodying the principles and concepts of an embodiment of the disclosure and generally designated by the reference numeral 10 will be described.

As best illustrated in FIGS. 1 through 6, the light emitting bowl assembly 10 generally comprises a bowl 12 that may be positioned on a support surface 14 such as a tabletop or the like. The bowl 12 has a bottom wall 16 and an outer wall 18 extending upwardly therefrom. The outer wall 18 has a distal edge 20 with respect to the bottom wall 16 defining an opening 22 into the bowl 12, an inside surface 24 and an outside surface 26. Additionally, the bowl 12 may have a diameter ranging between 30.0 cm and 50.0 cm.

The outer wall 18 has a first lip 28 extending inwardly from the inside surface 24. The first lip 28 is coextensive with the outer wall 18 such that the first lip 28 forms a closed loop. Moreover, the first lip 28 is spaced from the distal edge 20 of the outer wall 18 and the first lip 28 has an upwardly facing surface 30 and an inwardly facing surface 32. The outer wall 18 has a second lip 34 extending outwardly from the outside surface 26. The second lip 34 is coextensive with the outer wall 18 and the second lip 34 is aligned with the distal edge 20 of the outer wall 18.

A panel 36 is provided that has a first surface 38, a second surface 40 and a peripheral edge 42 extending therebetween. The peripheral edge 42 is continuous such that the panel 36 has a circular shape and the peripheral edge 42 is attached to the inwardly facing surface 32 of the first lip 28. The panel 36 has a plurality of first apertures 44 extending through the first surface 38 and the second surface 40. The first apertures 44 are spaced apart from each other and are distributed on the first panel 36. Additionally, the panel 36 may be comprised of a resiliently compressible material such as foam rubber or the like.

A disc 46 is positioned on the first surface 38 of the panel 36. The disc 46 completely covers the first surface 38 of the panel 36 and the upwardly facing surface 30 of the first lip 28. The disc 46 has a plurality of second apertures 48 extending therethrough. Each of the second apertures 48 is aligned with an associated one of the first apertures 44. A plurality of fasteners 50 is provided and each of the fasteners 50 extends through the disc 46 and engages the upwardly facing surface 30 of the first lip 28 to removably retain the disc 46 on the panel 36. Each of the fasteners 50 may be screws or the like.

A plurality of candle units 52 is provided and each of the candle units 52 is selectively positioned in the bowl 12.

Moreover, each of the candle units 52 is arranged in a selected arrangement in the bowl 12. Each of the candle units 52 is selectively turned on to emit light outwardly therefrom. In this way the candle units 52 enhances an ornamental appearance of the bowl 12 for festive and holiday displays.

Each of the candle units 52 comprises a cylinder 54 that has a first end 56 and a second end 58. The first end 56 has a well 60 extending toward the second end 58. The cylinder 54 corresponding to each of the candle units 52 may have a height and a diameter that is unique with respect to each other. A plug 62 is coupled to and extends downwardly from the second end 58 and the plug 62 is comprised of an electrically conductive material. The plug 62 is extended into a selected one of the first apertures 44 in the panel 36. The plug 62 may have a cylindrical shape to engage the selected first aperture.

A light emitter 64 is positioned in the well 60 to emit light outwardly therefrom. The light emitter 64 is electrically coupled to the plug 62 and the light emitter 64 may comprise an LED or the like. Additionally, the light emitter 64 may be shaped to resemble a flame on a wick of a candle. The light emitter 64 corresponding to each of the candle units 52 may emit a color of light that is unique with respect to each other. Additionally, the light emitter 64 corresponding to each of the candle units 52 may emit red, green and white light.

A power supply 66 is provided and the power supply 66 is coupled to the bowl 12. The power supply 66 is electrically coupled to each of the candle units 52 when the candle units 52 are positioned in the bowl 12. The power supply 66 comprises a plurality of contacts 68 and each of the contacts 68 is coupled to the second surface 40 of the panel 36. Each of the contacts 68 is aligned with an associated one of the first apertures 44 in the panel 36. The plug 62 corresponding to each of the candle units 52 is electrically coupled to the contact corresponding to the first apertures 44 when the plug 62 is inserted into the corresponding first aperture. A processor may be provided and the processor may selectively adjust an intensity of the light emitter 64 corresponding to each of the candle units 52 and actuate the light emitter 64 corresponding each of the candle units 52 to flicker on and off.

A switch 70 is coupled to the bowl 12 and the switch 70 is electrically coupled to each of the contacts 68 such that the switch 70 turns each of the contacts 68 on and off. A power port 72 is coupled the bowl 12 and the power port 72 is selectively electrically coupled to a power source 74. The power source 74 may be a plug on a charger or the like and the power port 72 is electrically coupled to each of the contacts 68. At least one battery 76 is positioned in the bowl 12 and the at least one battery 76 is electrically coupled to the switch 70. A battery cover 78 is removably coupled to the bottom wall 16 of the bowl 12. The at least one battery 76 is positioned beneath the battery cover 78.

A plurality of fiber optic lines may be provided and each of the fiber optic lines may be plugged into selected ones of the contacts 68. In this way each of the fiber optic lines may emit a selected color of light. Additionally, a plurality of ornamental plants 80 may be provided and the ornamental plants 80 may be arranged in the bowl 12. Each of the ornamental plants 80 may be fake plants comprised of plastic or the like.

In use, selected ones of the candle units 52 are plugged into selected ones of the first apertures 44 in the panel 36. Moreover, the candle units 52 may be arranged in a manner corresponding with holiday traditions. The switch 70 is manipulated to turn the light emitter 64 corresponding to each of the candle units 52 on such that the light emitter 64 corresponding to each the candle units 52 emits light. In this way holiday celebrations that involve candles may be practiced without the fire hazard associated with burning a real candle.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A light emitting bowl assembly being configured to be positioned as a centerpiece for festive holidays and occasions, said assembly comprising:

a bowl being configured to be positioned on a support surface;

a panel having a first surface, a second surface, and a plurality of first apertures, said panel being coupled to said bowl;

a plurality of candle units, each of said candle units being selectively positioned in said bowl, each of said candle units being arranged in a selected arrangement and said bowl, each of said candle units being selectively turned on wherein each of said candle units is configured to selectively emit light outwardly therefrom thereby enhancing an ornamental appearance of said bowl, each of said candle units comprising a cylinder having a first end and a second end, said first end having a well extending toward said second end, a plug being coupled to and extending downwardly from said second end, said plug being comprised of an electrically conductive material, said plug being extended into a selected one of said first apertures in said panel;

a power supply being coupled to said bowl, said power supply being electrically coupled to each of said candle units when said candle units is positioned in said bowl, said power supply including a plurality of contacts, each of said contacts being coupled to said second surface of said panel such that each of said contacts is aligned with and positioned at a bottom of an associated one of said first apertures in said panel, said plug corresponding to each of said candle units being electrically coupled to said contact corresponding to said first apertures when said plug is inserted into said corresponding first aperture.

2. The assembly according to claim 1, wherein said bowl has a bottom wall and an outer wall extending upwardly therefrom, said outer wall having a distal edge with respect to said bottom wall defining an opening into said bowl, said outer wall having an inside surface, said outer wall having a first lip extending inwardly from said inside surface, said first lip being coextensive with said outer wall such that said first lip forms a closed loop, said first lip being spaced from said distal edge of said outer wall, said first lip having an upwardly facing surface and an inwardly facing surface.

3. The assembly according to claim 2, further comprising said panel having a peripheral edge extending between said first surface and said second surface, said peripheral edge being continuous such that said panel has a circular shape, said peripheral edge being attached to said inwardly facing surface of said first lip.

4. The assembly according to claim 3, wherein said first apertures extend through said first surface and said second surface, said first apertures being spaced apart from each other and being distributed on said panel.

5. The assembly according to claim 4, further comprising a disc being positioned on said first surface of said panel such that said disc completely covers said first surface of said panel and said upwardly facing surface of said first lip.

6. The assembly according to claim 5, wherein said disc has a plurality of second apertures extending therethrough, each of said second apertures being aligned with an associated one of said first apertures.

7. The assembly according to claim 6, further comprising a plurality of fasteners, each of said fasteners extending through said disc and engaging said upwardly facing surface of said first lip to removably retain said disc on said panel.

8. The assembly according to claim 1, further comprising a light emitter being positioned in said well wherein said light emitter is configured to emit light outwardly therefrom, said light emitter being electrically coupled to said plug.

9. The assembly according to claim 1, further comprising a switch being coupled to said bowl wherein said switch is configured to be manipulated, said switch being electrically coupled to each of said contacts such that said switch turns each of said contacts on and off.

10. The assembly according to claim 9, further comprising a power port being coupled said bowl wherein said power port is configured to be selectively electrically coupled to a power source, said power port being electrically coupled to each of said contacts.

11. The assembly according to claim 10, further comprising at least one battery being positioned in said bowl, said at least one battery being electrically coupled to said switch.

12. A light emitting bowl assembly being configured to be positioned as a centerpiece for festive holidays and occasions, said assembly comprising:

a bowl being configured to be positioned on a support surface, said bowl having a bottom wall and an outer wall extending upwardly therefrom, said outer wall having a distal edge with respect to said bottom wall defining an opening into said bowl, said outer wall having an inside surface, said outer wall having a first lip extending inwardly from said inside surface, said first lip being coextensive with said outer wall such that said first lip forms a closed loop, said first lip being spaced from said distal edge of said outer wall, said first lip having an upwardly facing surface and an inwardly facing surface;

a panel having a first surface, a second surface and a peripheral edge extending therebetween, said peripheral edge being continuous such that said panel has a circular shape, said peripheral edge being attached to said inwardly facing surface of said first lip, said panel having a plurality of first apertures extending through said first surface and said second surface, said first apertures being spaced apart from each other and being distributed on said first panel;

a disc being positioned on said first surface of said panel such that said disc completely covers said first surface of said panel and said upwardly facing surface of said first lip, said disc having a plurality of second apertures extending therethrough, each of said second apertures being aligned with an associated one of said first apertures;

a plurality of fasteners, each of said fasteners extending through said disc and engaging said upwardly facing surface of said first lip to removably retain said disc on said panel;

a plurality of candle units, each of said candle units being selectively positioned in said bowl, each of said candle units being arranged in a selected arrangement and said bowl, each of said candle units being selectively turned on wherein each of said candle units is configured to selectively emit light outwardly therefrom thereby enhancing an ornamental appearance of said bowl, each of said candle units comprising:

a cylinder having a first end and a second end, said first end having a well extending toward said second end, a plug being coupled to and extending downwardly from said second end, said plug being comprised of an electrically conductive material, said plug being extended into a selected one of said first apertures in said panel, and a light emitter being positioned in said well wherein said light emitter is configured to emit light outwardly therefrom, said light emitter being electrically coupled to said plug; and a power supply being coupled to said bowl, said power supply being electrically coupled to each of said candle units when said candle units is positioned in said bowl, said power supply comprising:

a plurality of contacts, each of said contacts being coupled to said second surface of said panel such that each of said contacts is aligned with and positioned at a bottom of an associated one of said first apertures in said panel, said plug corresponding to each of said candle units being electrically coupled to said contact corresponding to said first apertures when said plug is inserted into said corresponding first aperture, a switch being coupled to said bowl wherein said switch is configured to be manipulated, said switch being electrically coupled to each of said contacts such that said switch turns each of said contacts on and off, a power port being coupled said bowl wherein said power port is configured to be selectively electrically coupled to a power source, said power port being electrically coupled to each of said contacts, and at least one battery being positioned in said bowl, said at least one battery being electrically coupled to said switch.

* * * * *